US008526665B2

(12) United States Patent
Lutz et al.

(10) Patent No.: US 8,526,665 B2
(45) Date of Patent: Sep. 3, 2013

(54) ELECTRO-ACOUSTIC TRANSDUCER COMPRISING A MEMS SENSOR

(75) Inventors: Josef Lutz, Rohrau (AT); Stefan Leitner, Baden (AT)

(73) Assignee: Knowles Electronics Asia PTE. Ltd., Singapore (SG)

( * ) Notice: Subject to any disclaimer, the term of this patent is extended or adjusted under 35 U.S.C. 154(b) by 419 days.

(21) Appl. No.: 12/671,031

(22) PCT Filed: Jul. 29, 2008

(86) PCT No.: PCT/IB2008/053037

§ 371 (c)(1),
(2), (4) Date: Jan. 28, 2010

(87) PCT Pub. No.: WO2009/016587

PCT Pub. Date: Feb. 5, 2009

(65) Prior Publication Data

US 2010/0195864 A1 Aug. 5, 2010

(30) Foreign Application Priority Data

Aug. 2, 2007 (EP) ..... 07113710

(51) Int. Cl.
*H04R 1/00* (2006.01)

(52) U.S. Cl.
USPC ..... 381/433; 381/369

(58) Field of Classification Search
USPC ..... 381/433, 174, 355, 415, 172, 369; 257/415, 419, 704
See application file for complete search history.

(56) References Cited

U.S. PATENT DOCUMENTS

| | | | | |
|---|---|---|---|---|
| 6,594,369 | B1 * | 7/2003 | Une | 381/174 |
| 8,184,845 | B2 * | 5/2012 | Leidl et al. | 381/369 |
| 2005/0185812 | A1 * | 8/2005 | Minervini | 381/355 |
| 2006/0157841 | A1 | 7/2006 | Minervini | |

(Continued)

FOREIGN PATENT DOCUMENTS

DE 10 2004 011 148 B3 11/2005

OTHER PUBLICATIONS

International Search Report for Int'l. Patent Appln. No. PCT/IB2008/053037 (Dec. 15, 2008).

*Primary Examiner* — Duc Nguyen
*Assistant Examiner* — Phan Le
(74) *Attorney, Agent, or Firm* — Steven McMahon Zeller; Dykema Gossett PLLC

(57) ABSTRACT

An electro-acoustic transducer (1) is disclosed, comprising a substrate (2) that comprises conducting paths (3), a cover (4) attached to said substrate (2) thus forming an inner chamber (A) and a space (B) outside said chamber (A), wherein said cover (4) comprises one or more ports (5). A MEMS sensor (6) of said transducer (1) has at least one hole (7) extending from a first side (C) to a second side (D). A membrane (8) is arranged in said hole (7) transverse to the hole axis (E) thus forming a first hole space (a) and a second hole space (b). The sensor (6) furthermore has electrical connectors (9) designed to carry electrical signals representing sound acting on said membrane (8), which connectors (9) are connected to said conducting paths (3). According to the invention, said MEMS sensor (6) is arranged inside said chamber (A) in such a way that said second hole space (b) is connected to said outside space (B) via said port or ports (5) and said first hole space (a) is connected to said inner chamber (A).

16 Claims, 3 Drawing Sheets

(56) References Cited

U.S. PATENT DOCUMENTS

2006/0280319 A1* 12/2006 Wang et al. ..... 381/172
2007/0286437 A1* 12/2007 Mullenborn et al. ..... 381/174
2007/0291964 A1* 12/2007 Chien et al. ..... 381/174
2009/0001553 A1* 1/2009 Pahl et al. ..... 257/704
2009/0014819 A1* 1/2009 Loeffler et al. ..... 257/415
2009/0278217 A1* 11/2009 Laming et al. ..... 257/419

* cited by examiner

ELECTRO-ACOUSTIC TRANSDUCER COMPRISING A MEMS SENSOR

FIELD OF THE INVENTION

The invention relates to a electro-acoustic transducer, comprising a substrate with conducting paths, a cover attached to said substrate thus forming an inner chamber and a space outside said chamber wherein said cover comprises one or more ports, and a Micro Electro Mechanical Systems sensor, MEMS sensor for short, comprising a first side and second side and at least one hole extending from the first side to the second side wherein a membrane is arranged in said hole transverse to the hole axis thus forming a first hole space and a second hole space and having electrical connectors designed to carry electrical signals representing sound acting on said membrane, which connectors are connected to said conducting paths.

BACKGROUND OF THE INVENTION

An example of such an electro-acoustic transducer is known from US 2006/0157841, which discloses a silicon condenser microphone package including a transducer unit, a substrate, and a cover. The transducer unit is attached to an upper surface of the substrate and overlaps at least a portion of a recess wherein a back volume of the transducer unit is formed between the transducer unit and the substrate. The cover is placed over the transducer unit and either the cover or the substrate includes an aperture.

Generally, the membrane of an electro-acoustic transducer (or a pressure sensor) just senses the difference of the pressure in front of the membrane and behind the membrane. For a microphone this means that sound waves vary the pressure in front of the membrane whereas the pressure behind the membrane is held substantially constant. This is done by means of a back volume, which for high sensitivity of the transducer shall not be too small. Roughly speaking, the back volume depends on the compliance of the membrane for a given sensitivity. Because a membrane cannot be arbitrarily compliant, the back volume has to have a certain size. However, a big back volume is a contradiction to the ever decreasing size of electronic devices.

According to prior art, a back volume is either formed in the die of the MEMS sensor and/or in the substrate, to which the MEMS sensor is attached, and/or in the PCB (printed circuit board) of the device, to which the transducer is attached (e.g. the PCB of a mobile phone). For this reason the measures to obtain a back volume with a sufficient size are relatively extensive. Hence, it is an object of the invention, to propose an electro-acoustic transducer which overcomes these drawbacks.

OBJECT AND SUMMARY OF THE INVENTION

The object of the invention is achieved by an electro-acoustic transducer of the kind disclosed in the first paragraph wherein said MEMS sensor is arranged inside said chamber in such a way that said second hole space is connected to said outside space via said port or ports and said first hole space is connected to said inner chamber.

Such an arrangement has some considerable advantages:

The back volume is bigger and thus the sensitivity of the transducer is better than in prior art arrangements;

The height of the transducer can be reduced to a minimum;

The fabrication of the substrate and a PCB for a device is r as no recesses are required;

The assembly of the transducer is simpler as no sealing between substrate and MEMS sensor is required.

In a preferred embodiment, said electrical connectors are arranged on said first side and connected to said conducting paths by means of flip chip technology. One advantage is that the upper side of the MEMS sensor is free of contacts, to which—if wire bonding were used—in addition very thin and fragile wires would be attached. Accordingly, flip chip technology is quite robust, in particular against damages which can occur when the cover is attached to the substrate and the MEMS sensor. As an optional sealing between cover and sensor is arranged on the second side (i.e. vis-à-vis of the contacts), furthermore the danger of contaminating the contacts with the sealing (which is commonly a glue) is almost zero.

In a further preferred embodiment, said connections between said electrical connectors and said conducting paths are designed in such a way that channels between said substrate and said MEMS sensor are formed, which channels connect said first hole space to said inner chamber. On the one hand, this is a very efficient way to manufacture the necessary connection between first hole space and inner chamber because naturally there is a certain stand off between MEMS sensor and substrate (wherein the stand off height moreover can simply be varied by variation of the amount of solder or conductive glue which is used). On the other hand, a bigger gap has a positive influence on the temperature sensitivity of the MEMS sensor.

In yet another preferred embodiment, a groove is formed in said first side, which groove connects said first hole space to said inner chamber. This is a very useful possibility to enlarge the connection between first hole space and inner chamber without increasing the stand off between MEMS sensor and substrate.

In another embodiment, the electrical connectors are arranged on said second side and connected to said conducting paths by means of wire bonds. This possibility is particularly advantageous if existing machinery shall be used for the fabrication of the inventive transducer. Again it is advantageous, if a groove is formed in first side, which groove connects said first hole space to said inner chamber. This is a measure to obtain the necessary connection between first hole space and inner chamber if the MEMS sensor is glued to the substrate.

In a further preferred embodiment, the inventive transducer additionally comprises means for equalizing the air pressure between said chamber and said outside space. As known, the air pressure in the environment of the electro-acoustic transducer is not just subjected to sound but also to long term variations, e.g. because of weather or moves in relation to sea level. To avoid an undesired influence on the membrane, the electro-acoustic transducer comprises means for equalizing the air pressure between said chamber and said outside space.

A very simply possibility to manufacture said equalizing means is providing one ore more of a hole in the substrate; a hole in the cover; a hole in the MEMS sensor; a hole in the membrane, or a port formed by said cover and the substrate or the MEMS sensor, in particular by a break of a sealing between said cover and the substrate or the MEMS sensor. As known per se, the acoustic resistance of these holes has to be reasonably high so that they influence the performance of the electro-acoustic transducer only below its working frequency range. Alternatively, the equalizing means may also be designed as any kind of a vent.

In yet another advantageous embodiment, the inventive transducer additionally comprises one or more integrated circuits (IC) inside said chamber, which cooperate with said MEMS sensor. Commonly, the electrical signal coming from the MEMS sensor requires post processing of the same, basically amplification and linearization. In principle this can be done within the MEMS sensor. However, because the technology and process steps to manufacture a MEMS sensor and an integrated circuit for post processing of the sensor signals considerably differ from another, usually separate devices are used. Often a so-called ASIC (Application Specific Integrated Circuit) is used for post processing. However, also a standard circuit may be provided for this functionality. A further advantage of the IC being arranged inside the inner chamber is the light protection for the same. This is important as ASICs are sensitive to light. Finally, (provided the cover is made of metal or at least comprises a metal layer) the influence of electromagnetic radiation on the IC is reduced as the electromagnetic shielding is not disrupted by holes in the region of the IC. Hence, the electromagnetic compatibility (EMC) is improved.

Traditional transducers furthermore suffer from a relatively large distance between the MEMS sensor and the ASIC because a sealing has to be applied between the sensor and the substrate. By contrast, the present transducer has (if at all) a sealing between the cover and the sensor which is much easier to fabricate. Hence, the distance between sensor and ASIC can be lowered what results in smaller overall dimensions for the electro-acoustic transducer.

Furthermore, it is preferred if said cover is air-tightly attached to said substrate and to said second side of said MEMS sensor. A sealing between cover and substrate and cover and sensor is not mandatory, provided the gap between the parts is reasonably small. However, to eliminate the influence of the tolerances of the parts on the function of the electro-acoustic transducer, a sealing (e.g. glue) can be provided. Whereas "air tight" with respect to a gap means "no considerable influence on the acoustic performance of the transducer in its working frequency area", "air tight" with respect to a sealing has an absolute meaning.

Moreover, it is advantageous if the volume of said first hole space and/or said second hole space is zero. The advantage of an arrangement, in which the membrane is arranged in the middle of the hole of the MEMS sensor is that mechanical stress acting on the MEMS sensor does not considerably influence the membrane as it is arranged in the neutral zone of the sensor. However, common MEMS sensors have the membrane at one end of the hole (see also US 2006/0157841) as the fabrication process is simpler. Here a groove is etched from just one side of the die so that the membrane is formed. One can also imagine, that the sensor is as flat as the membrane. Accordingly, the volume of said first hole space and/or said second hole space is reduced to zero. It should be noted that the volume of the hole spaces does not have a considerable influence on the principle function of the membrane. There is just a contribution (or not) to the effective back volume of the transducer.

In yet another preferred embodiment, the transducer additionally comprises a dust cover over the cover forming a gap between them, wherein said dust cover comprises at least one port which is offset against said port or ports of said cover. In this way, dust particles and bigger particles can be kept away from the MEMS sensor. Particles bigger than the port in the cover, the gap, or the port in the dust cover are kept away from the sensor anyway. Smaller particles are likely to be attracted by the cover or the dust cover before they reach the port in the cover.

Preferably, an adhesive is attached to the surface of the cover facing the gap and/or the surface of the dust cover facing the gap because so dust particles are even more likely to be "catched" before they reach the port in the cover. The adhesive can be applied to the whole surface or can have the shape of a strip, in particular a strip with a break so that dust particles cannot clog the sound path between the port in the dust cover and the port in the cover.

In yet another preferred embodiment, the cover of the inventive transducer comprises a dent designed to form a gap together with a housing of a device, into which said transducer is built. Again, dust particles and bigger particles can be kept away from the MEMS sensor, however, without the special need of a dedicated dust cover.

Preferably, an adhesive is attached to the surface of the dent because again dust particles are more likely to be "catched" before they reach the port in the cover. The adhesive can be applied to the whole surface or can have the shape of a strip, in particular a strip with a break so that dust particles cannot clog the sound path between the port in the dust cover and the port in the cover. These and other aspects of the invention are apparent from and will be elucidated with reference to the embodiments described hereinafter.

BRIEF DESCRIPTION OF THE DRAWINGS

The invention will be described in greater detail hereinafter, by way of non-limiting examples, with reference to the embodiments shown in the drawings.

DESCRIPTION OF EMBODIMENTS

Figure 1:
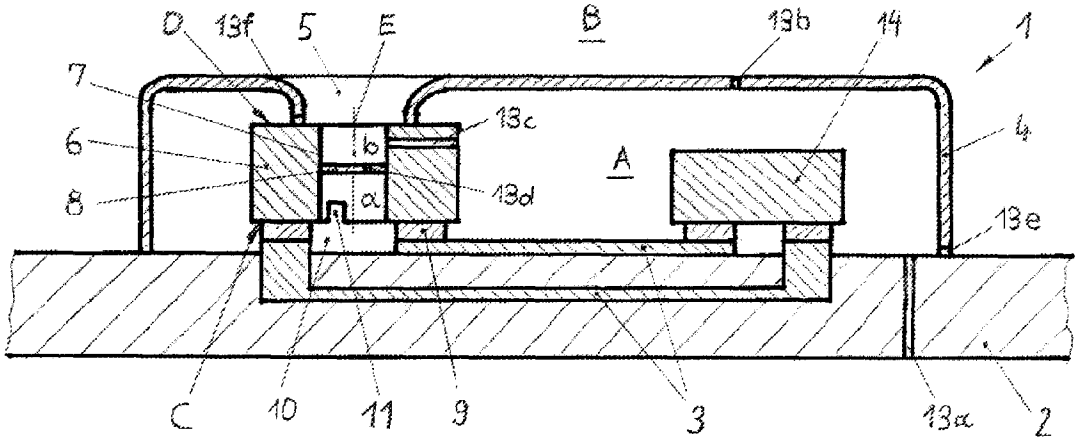
FIG. 1 shows an electro-acoustic transducer with a MEMS sensor flip chipped to a substrate.

FIG. 1 shows an electro-acoustic transducer 1, which is designed as a microphone in this example. The microphone 1 comprises a substrate 2, a cover 4, a MEMS sensor 6, and an additional integrated circuit 14.

The MEMS sensor 6 comprises a first side C and a second side D, basically a bottom and an upper side of the MEMS sensor 6 in this example. Furthermore, the MEMS sensor 6 comprises a hole 7 extending from said first side C to the second side D. In the hole 7 a membrane 8 is arranged transverse to the hole axis E. Hence, a first hole space a and a second hole space b is formed. Finally, the MEMS sensor 6 comprises connectors 9 designed to carry electrical signals representing sound acting on the membrane 8. Commonly, a membrane is arranged vis-à-vis a back plate, which is not shown in FIG. 1. Both the membrane and the back plate form a capacitor. When air pressure (here in form of sound) acts on the membrane the distance between the membrane and the back plate and thus the capacitance of the capacitor changes. This change is used to convert sound to electrical signals in a well-known manner. The processing of these signals within the MEMS sensor 6 is not excluded, but not provided in this example. Accordingly, the MEMS sensor 6 is a pure electro-acoustic transducer in this example.

The substrate 2 comprises conducting paths 3 (in this particular example in different layers which of course is not mandatory) which on the one hand form contact pads, to which the MEMS sensor 6 and the integrated circuit 14 are connected, and connections between the MEMS sensor 6 and the integrated circuit 14. In this particular example the integrated circuit 14 is designed as an ASIC (Application Specific Integrated Circuit) for post processing of the signals from the MEMS sensor 6, e.g. amplification linearization of the signals.

The cover 4 is attached to said substrate 2 thus forming an inner chamber A and a space B outside said chamber A. In addition, the cover 4 comprises a port 5. The MEMS sensor 6 and the integrated circuit 14 are arranged in this inner chamber A, however, the MEMS sensor 6 in a special way. The first hole space (a) is connected to the inner chamber A such that a media flow respectively media exchange is possible and likewise the second hole space (b) is connected to the outside space B.

The first connection is achieved by a channel 10, which basically is a gap between the substrate 2 and the first side C of the MEMS sensor 6, which results when the sensor 6 is soldered (or glued by means of conductive glue) to the substrate 2. On the one hand, the MEMS sensor 6 comprises connectors 9 with a definite height, on the other hand, the conducting paths 3 (in particular the contact pads) extend from the surface of the substrate 2. In other words, the height of the gap is the sum of the height of the connectors 9 and the conducting paths 3. However, in reality the gap is larger as also the solder or the glue has a definite thickness. It should be noted that neither the connectors 9 nor the conducting paths 3 necessarily protrude from the first side C or the substrate 2. In this case, the gap results only from the thickness of the solder or the glue.

The connection between the second hole space b and the outside space B is simply achieved by the port 5 in the cover 4.

The electro-acoustic transducer 1 functions as explained hereinafter. It is assumed that there is a sound source in the outside space B. Sound approaches the electro-acoustic transducer 1, passes the port 5 and the second hole space b, and finally acts on the membrane 8. As stated hereinbefore, a change of the capacitance of the capacitor, which is formed by the membrane 8 and a back plate, is used to convert sound to electrical signals.

In addition to the electro-acoustic conversion, sound acting on the membrane 8 also causes pressure fluctuations in the first hole space a and the inner chamber A, which both form the so-called "back volume" of the electro-acoustic transducer 1. In this context, the channel 10 forms an acoustic resistance between the first hole space a and the inner chamber A, which resistance influences the performance of the electro-acoustic transducer 1 as known per se. A possibility to set the height of the channel 10 is to use a certain quantity of solder or glue. The more solder or glue is used the higher the channel and thus the lower the resistance. It should be noted that also the volume of the first hole space a, the volume of the inner chamber A and the compliance of the membrane 8 influences the performance of the electro-acoustic transducer 1 in a well known manner. One further possibility to lower the acoustic resistance is providing one or more grooves 11 in the first side C of the MEMS sensor 6.

As known, the air pressure in the environment of the electro-acoustic transducer 1 is also subject to long term variations, e.g. because of weather or moves in relation to sea level. To avoid an undesired influence on the membrane 8, the electro-acoustic transducer 1 may comprise means for equalizing the air pressure between said chamber A and said outside space B. A solution for these equalizing means is a hole 13*a* in the substrate 2 and/or a hole 13*b* in the cover 4 and/or a hole 13*c* in the MEMS sensor 6 and/or a hole 13*d* in the membrane 8. Alternatively or in addition, the equalizing means may also be designed as a port 13*e* formed by the cover 4 and the substrate 2, in particular by a break of a sealing, which may be provided between the cover 4 and the substrate 2. Another solution is a groove in the cover 4, which becomes a hole when the cover 4 is attached to the substrate 2. In a similar way, the equalizing means may also be designed as a port 13*f* formed by the cover 4 and the MEMS sensor 6, in particular by a break of a sealing, which may be provided between the cover 4 and the MEMS sensor 6. Another solution is a groove in the cover 4, which becomes a hole when cover 4 is attached to the MEMS sensor 6. As known per se, the acoustic resistance of these holes has to be reasonably high so that they influence the performance of the electro-acoustic transducer 1 only below its working frequency range.

Figure 2:
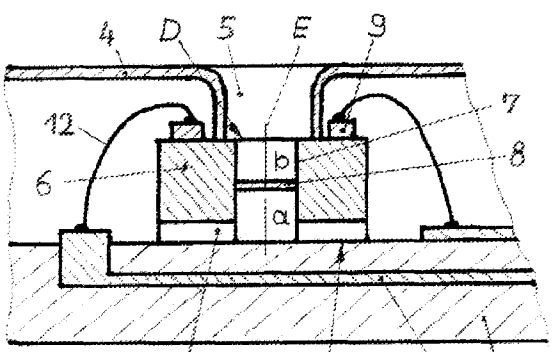
FIG. 2 shows an electro-acoustic transducer with a MEMS sensor wire bonded to a substrate.

FIG. 2 shows a section of another electro-acoustic transducer 1, which except differences stated hereinafter is identical to the embodiment shown in FIG. 1. In FIG. 1 the MEMS sensor 6 is attached to the substrate 2 by means of the flip chip technology. By contrast, the MEMS sensor 6 is wire bonded to the substrate 2 in this embodiment. Accordingly, the electrical connectors 9 of the MEMS sensor 6 are not on the first side C (which is glued to the substrate 2) but on the second side D, which basically is the top of the MEMS sensor 6. The connection between the connectors 9 and the conducting paths 3 on the substrate 2 is achieved by wire bonds 12.

Figure 3:
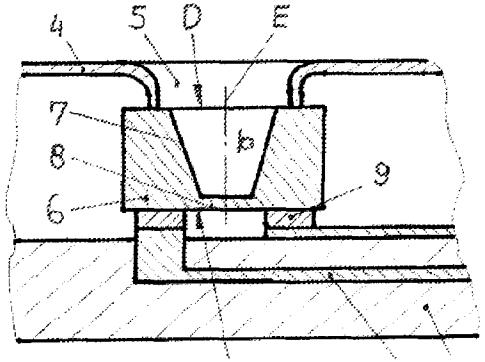
FIG. 3 shows an electro-acoustic transducer with a MEMS sensor with a membrane at the bottom of the device.

FIG. 3 shows a section of another electro-acoustic transducer 1, which except differences stated hereinafter is identical to the embodiment shown in FIG. 1. In FIG. 1 the membrane 8 is arranged right in the middle of the hole 7. This has the advantage that mechanical stress acting on the MEMS sensor 6 does not considerably influence the membrane 8 because it is arranged in the neutral zone of the MEMS sensor 6. However, traditional MEMS transducers have the membrane 8 at one end of the hole 7. One such embodiment is shown in FIG. 3. Here the membrane 8 is arranged in line with the first side C so that the first hole space a is reduced to zero. However, the membrane 8 may also be arranged in line with the second side D what then causes the second hole space b being reduced to zero. Finally, the thickness of the membrane 8 may be identical with the height of the MEMS sensor 6. In this case, the volumes of both the first hole space a and the second hole space b are reduced to zero. It should be noted that the volumes of the hole spaces a and b do not have a considerable influence on the principle function of the membrane 8. There is just a possibility of the first hole space a contributing to the effective back volume of the transducer 1. It should also be noted that the membrane 8 in FIGS. 1 and 2 is shown as a part separate from the MEMS sensor 6 whereas the membrane 8 and the MEMS sensor 6 consist of the same material in FIG. 3. However, also the membrane 8 in FIGS. 1 and 2 may consist of the same material as the MEMS sensor 6, and the membrane 8 in FIG. 3 may consist of a material different from that of the MEMS sensor 6.

Figure 4:
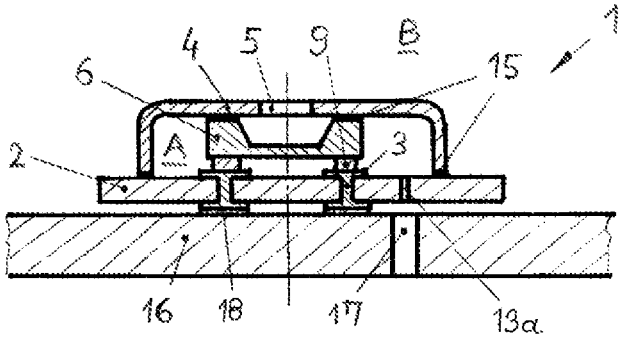
FIG. 4 shows an electro-acoustic transducer attached to a PCB of a further device.

FIG. 4 shows another embodiment of an electro-acoustic transducer 1, which except differences stated hereinafter is identical to the embodiment shown in FIG. 3 (note that the section of FIG. 4 is transverse to the section of FIG. 3 so that the integrated circuit 14 cannot be seen). One difference is that the port 5 is not funnel-shaped but simply a hole in the cover 4. Hence, the electro-acoustic transducer 1 is flatter than the one of FIG. 3. Furthermore a sealing compound 15

(which may be simply glue) is used to seal the connection between the cover 4 and the substrate 2 and between the cover 4 and the MEMS sensor 6. Moreover, the electro-acoustic transducer 1 is attached to a printed circuit board 16 (PCB for short) of another device, e.g. a mobile phone. For this reason, the conducting paths 3 have vias from the upper side to the bottom side of the substrate 2, where the conducting paths 3 are electrically connected to device contacts 18 arranged on the PCB 16. Finally, the PCB 16 comprises a hole 17 which is in line with the hole 13*a* in the substrate 2 and serves for equalizing the air pressure between the inner chamber A and the outside space B. However, this hole 17 may be omitted if the gap between substrate 2 and PCB 16 is sufficiently large.

Figure 5A:
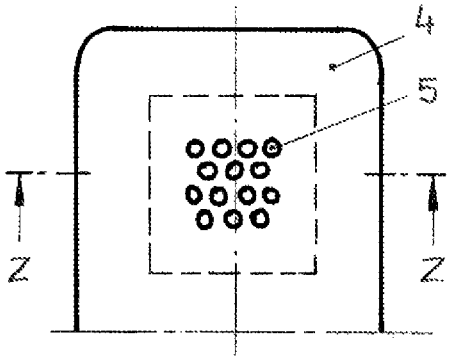
FIGS. 5*a* and 5*b* show an electro-acoustic transducer attached to a PCB with extended back volume.
Figure 5B:
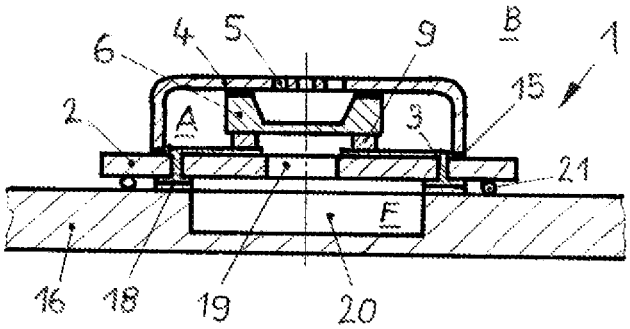

FIGS. 5*a* and 5*b* show another embodiment of an electro-acoustic transducer 1, which except differences stated hereinafter is identical to the embodiment shown in FIG. 4 (FIG. 5*a* top view, FIG. 5*b* section along plane Z-Z). In this embodiment the cover 4 comprises a plurality of small ports 5. This helps to keep dust particles away from the MEMS sensor 6. Furthermore, the substrate 2 comprises a hole 19, which connects the inner chamber A to a PCB chamber F. This PCB chamber F includes a recess 20 in the PCB 16 and the volume formed by the gap between substrate 2 and PCB 16 inside a device sealing 21. As known per se, the back volume influences the performance of the electro-acoustic transducer 1. This embodiment shows how to increase the back volume without increasing the inner chamber A what may be useful if very small transducers 1 are desired.

Figure 6A:
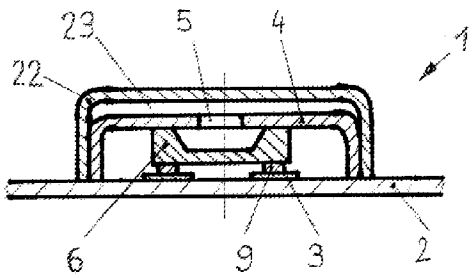
FIGS. 6*a* and 6*b* show an electro-acoustic comprising an additional dust cover.
Figure 6B:
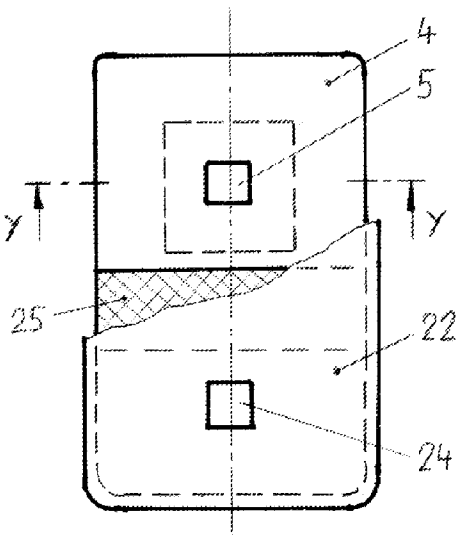

FIGS. 6*a* and 6*b* show another embodiment of an electro-acoustic transducer 1, which except differences stated hereinafter is identical to the embodiment shown in FIG. 3 (FIG. 6*a* section along plane Y-Y, FIG. 6*b* top view). In this embodiment the cover 4 has a planar upper surface and a port 5. To keep dust particles and bigger particles away from the MEMS sensor 6, a dust cover 22 is placed on top of the cover 4. Between the cover 4 and the dust cover 22 there is a small gap 23. Moreover, the dust cover 22 has a port 24 which is offset against the port 5. Accordingly, particles bigger than the port 5, the gap 23 or the port 24 are kept away from the sensor 6 anyway. Smaller particles are likely to be attracted by the cover 4 or the dust cover 22 before they reach the port 5. This effect can be enhanced if an adhesive is attached to the surface of the cover 4 facing the gap 23 and/or the surface of the dust cover 22 facing the gap 23. The adhesive can be applied to the whole surface or can have the shape of a strip of adhesive 25 as shown in the FIG. 6*b*. It should be noted that sealings as shown in FIGS. 4 and 5*b* may be provided in this embodiment as well. Finally, one can perceive that there can also be a gap between the lateral surfaces of the cover 4 and the dust cover 22 or there may be no parallel side walls at all if the dust cover 22 does not rest on the substrate 2 but directly on the cover 4.

Figure 7A:
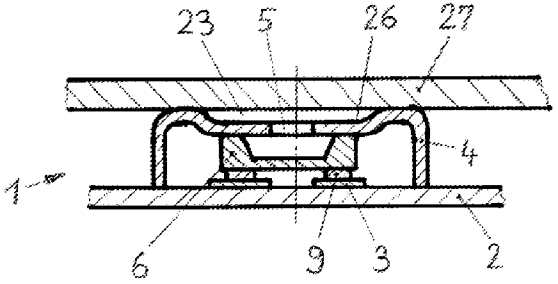
FIGS. 7*a* and 7*b* show an electro-acoustic wherein the housing of a device, into which the transducer is built, is used instead of a dedicated dust cover.
Figure 7B:
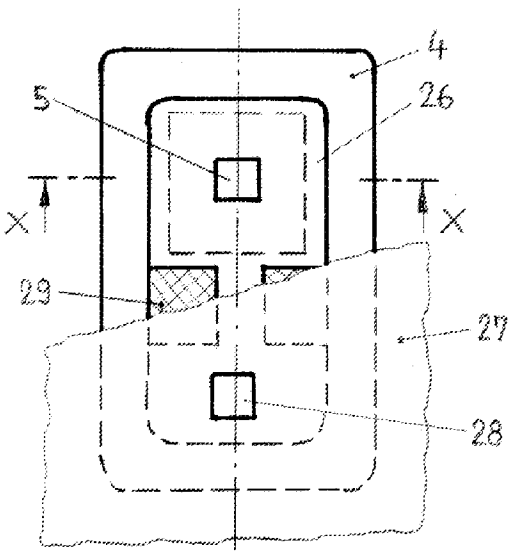

FIGS. 7*a* and 7*b* show yet another embodiment of an electro-acoustic transducer 1, which except differences stated hereinafter is identical to the embodiment shown in FIGS. 6*a* and 6*b* (FIG. 7*a* section along plane X-X, FIG. 7*b* top view). The cover 4 has a dent 26 in the central region of the upper surface. Instead of a dedicated dust cover 22, a housing 27 of a device (e.g. a mobile phone), into which the transducer 1 built, is provided. The housing 27 comprises a port 28 as a sound opening. Both the dent 26 and the housing 25 are used to form the gap 23. Additionally, a sealing (e.g. a glue) can be provided between the cover 4 and the housing 27. Again, an adhesive can be provided to attract dust. In this embodiment a strip of adhesive 29 is provided, which has a gap (here in the middle—what is not mandatory). In this way it can be avoided that dust particles clog the sound path between port 5 and port 28 in the course of time.

It should be noted that although the embodiments are directed to capacitive MEMS sensors, the invention of course also applies to piezo sensors, electret sensors, and inductive sensors.

Finally, it should be noted that the above-mentioned embodiments illustrate rather than limit the invention, and that those skilled in the art will be capable of designing many alternative embodiments without departing from the scope of the invention as defined by the appended claims. In the claims, any reference signs placed in parentheses shall not be construed as limiting the claims. The verb "comprise" and its conjugations do not exclude the presence of elements or steps other than those listed in any claim or the specification as a whole. The singular reference of an element does not exclude the plural reference of such elements and vice-versa. In a device claim enumerating several means, several of these means may be embodied by one and the same item of software or hardware. The mere fact that certain measures are recited in mutually different dependent claims does not indicate that a combination of these measures cannot be used to advantage.

The invention claimed is:

1. An electro-acoustic transducer, comprising: a substrate comprising a plurality of conducting paths; and a cover attached to said substrate thus forming an inner chamber and a space outside said chamber, wherein said cover comprises at least one port; and a MEMS sensor comprising a first side and second side and at least one hole extending from the first side to the second side and a membrane being arranged in said hole transverse to the hole axis thus forming a first hole space and a second hole space and having a plurality of electrical connectors adapted to carry electrical signals representing sound acting on said membrane, the connectors being connected to said conducting paths; and a mechanism for equalizing air pressure between said chamber and said outside space, said mechanism comprising at least on of a hole in the substrate, a hole in the cover, a hole in the MEMS sensor, a hole in the membrane, and a port formed by said cover and the substrate or the MEMS sensor, in particular by a break of a seal between said cover and the substrate or the MEMS sensor;

wherein said first side of said MEMS sensor is attached to said substrate and said second side of said MEMS sensor is attached to said cover; and wherein said MEMS sensor is arranged inside said chamber in such a way that said second hole space is connected to said outside space via said at least one port and said first hole space is connected to said inner chamber via at least one gap formed between said first side and said substrate.

2. The electro-acoustic transducer according to claim 1, wherein said electrical connectors are arranged on said first side and connected to said conducting paths by flip chip technology.

3. The electro-acoustic transducer according to claim 2, wherein said gap comprises a channel formed between two of said connections between said electrical connectors and said conducting paths.

4. The electro-acoustic transducer according to claim 2, wherein said gap comprises a groove formed in said first side, which groove connects said first hole space to said inner chamber.

5. The electro-acoustic transducer according to claim 1, wherein said electrical connectors are arranged on said second side and connected to said conducting paths by wire bonds.

6. The electro-acoustic transducer according to claim 5, wherein said gap comprises a groove formed in said first side, which groove connects said first hole space to said inner chamber.

7. The electro-acoustic transducer according to claim 1, additionally comprising one or more integrated circuits inside said chamber, which cooperate with said MEMS sensor.

8. The electro-acoustic transducer according to claim 1, wherein said cover is air-tightly attached to said substrate and to said second side of said MEMS sensor.

9. The electro-acoustic transducer according to claim 1, wherein the volume of at least one of said first hole space and said second hole space is zero.

10. The electro-acoustic transducer according to claim 1, further comprising a dust cover over the cover forming a gap between them, wherein said dust cover comprises at least one port which is offset against said port or ports of said cover.

11. The electro-acoustic transducer according to claim 10, wherein an adhesive is applied to at least one of the surface of the cover facing the gap and the surface of the dust cover facing the gap.

12. The electro-acoustic transducer according to claim 1, wherein said cover comprises a dent that forms a gap together with a housing of a device, into which said transducer is built.

13. The electro-acoustic transducer according to claim 12, wherein an adhesive is applied to the surface of the dent.

14. An electro-acoustic transducer comprising: a substrate comprising a plurality of conducting paths; a cover having a port, the cover attached to the substrate and forming an inner chamber; and a MEMS sensor disposed within the inner chamber, the MEMS sensor comprising: a first side; a second side opposite the first side; a hole extending from the first side to the second side; a membrane disposed within the hole, the membrane having a first side facing the same direction as the first side of the MEMS sensor, and a second side facing the same direction as the second side of the MEMS sensor; and a plurality of electrical connectors configured to carry electrical signals representing sound acting on the membrane, the connectors being connected to said conducting paths; and a mechanism for the equalizing air pressure between the inner chamber and a space outside of the inner chamber, the mechanism comprising at least one of a hole in the substrate, a hole in the cover, a hole in the MEMS sensor, a hole in the membrane, and a port formed by the cover and the substrate or the MEMS sensor, in particular by a break of a seal between the cover and the substrate or the MEMS sensor;

wherein the first side of the MEMS sensor is attached to the cover and configured such that the first side of the membrane is acoustically connected to the ports in the cover; and wherein the second side of the MEMS sensor is attached to the substrate and configured such that the second side of the membrane is acoustically connected to the inner chamber via at least one gap between the second side and the substrate.

15. The electro-acoustic transducer of claim 14, wherein the plurality of electrical connectors are arranged on the second side of the MEMS sensor and the gap between the second side and the substrate is formed by a channel created between two of the connections of the electrical connectors and the conducting paths on the substrate.

16. The electro-acoustic transducer of claim 14, wherein the gap between the second side and the substrate is formed by a groove formed in the second side of the MEMS sensor.

* * * * *

UNITED STATES PATENT AND TRADEMARK OFFICE

CERTIFICATE OF CORRECTION

PATENT NO. : 8,526,665 B2
APPLICATION NO. : 12/671031
DATED : September 3, 2013
INVENTOR(S) : Lutz et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 452 days.

Signed and Sealed this
Fifteenth Day of September, 2015

Michelle K. Lee

Michelle K. Lee
*Director of the United States Patent and Trademark Office*